United States Patent [19]

Harandi

[11] Patent Number: 4,853,103

[45] Date of Patent: Aug. 1, 1989

[54] LUBE CATALYTIC DEWAXING-HYDROTREATING PROCESS

[75] Inventor: Mohsen N. Harandi, Lawrenceville, N.J.

[73] Assignee: Mobil Oil Corporation, New York, N.Y.

[21] Appl. No.: 179,727

[22] Filed: Apr. 11, 1988

[51] Int. Cl.[4] ..... C10G 45/64; C10G 45/00

[52] U.S. Cl. ..... 208/58; 208/111; 502/52

[58] Field of Search ..... 208/58, 97, 111, 143; 502/38, 52

[56] References Cited

U.S. PATENT DOCUMENTS

| | | | |
|---|---|---|---|
| 2,330,462 | 9/1943 | Weiland | 502/38 |
| 2,941,954 | 6/1960 | Wilkes | 502/38 |
| 3,069,362 | 12/1962 | Mays et al. | 252/419 |
| 3,069,363 | 12/1962 | Mays et al. | 252/419 |
| 3,450,644 | 6/1969 | Lanewala | 502/38 |
| 3,764,558 | 10/1973 | Tse et al. | 502/52 |
| 3,894,938 | 7/1985 | Gorring et al. | 208/97 |
| 4,162,962 | 7/1979 | Stanhgeland | 208/58 |
| 4,181,598 | 1/1980 | Gillespie et al. | 208/58 |
| 4,247,388 | 1/1981 | Banta et al. | 208/111 |
| 4,294,687 | 10/1981 | Pinaire et al. | 208/58 |
| 4,358,395 | 11/1982 | Haag et al. | 252/411 R |
| 4,508,836 | 4/1985 | Haag et al. | 585/460 |
| 4,560,670 | 12/1985 | Pelrine | 208/28 |

*Primary Examiner*—Glenn Caldarola

*Attorney, Agent, or Firm*—Alexander J. McKillop; Charles J. Speciale; Malcolm D. Keen

[57] ABSTRACT

A catalytically dewaxed lubricating oil of improved oxidation stability is produced by catalytically dewaxing and hydrotreating the dewaxed product with a hydrotreating catalyst which has been oxidatively regenerated. The use of oxidative regeneration provides a hydrotreating catalyst which effectively sorbs aromatic components, especially the polycyclic aromatic liquids formed during the hydrogen activation of the dewaxing catalyst which pass out of the dewaxing reactor during the initial stages of each dewaxing cycle.

7 Claims, No Drawings

LUBE CATALYTIC DEWAXING-HYDROTREATING PROCESS

FIELD OF THE INVENTION

This invention relates to the production of lubricants of low pour point by catalytic dewaxing.

BACKGROUND OF THE INVENTION

Catalytic dewaxing of various refined petroleum product fractions is now well established. Initial proposals were set out in U.S. Pat. No. 3,668,113 and Oil and Gas Journal, Jan. 6, 1975, pages 69–73. Since then, catalytic dewaxing of middle distillate and lube fractions has become well known. See, for example, U.S. Pat. Nos. Re 28398, 4,181,598, 4,247,388 and 4,443,327. The MLDW (Mobil Lube Dewaxing) catalytic dewaxing process for producing low pour point lubricants by dewaxing a lube boiling range feed in the presence of hydrogen over an intermediate pore size zeolite as the dewaxing catalyst has now become established. See, for example, 1986 Hydrocarbon Processing Handbook, Hydrocarbon Processing, September 1986, page 90. The MLDW process is described in Oil and Gas Journal, May 26, 1980, 75–84 and by Chen et al in "Industrial Application of Shape-Selective Catalysis", Catal. Rev. - Sci. Eng. 28 (243), 185–264 (1986), especially 244–247, to reference is made for a description of the process.

As described in the Chen article, the MLDW process utilizes a two-reactor system in which the effluent from the dewaxing reactor is cascaded to a hydrotreating reactor in which the dewaxed lube product is stabilised by saturation of lube boiling range olefins produced during the dewaxing step and removal of heteroatoms containing impurities and color bodies. Saturation of residual aromatics may also take place at higher hydrotreating pressures, typically about 2000 psig (about 13890 kPa abs). The use of a hydrotreating step in combination with the dewaxing step is also described in U.S. Pat. Nos. 3,894,938 and 4,181,598 (Gillespie) to which reference is made for details of such processes.

During the dewaxing process, the dewaxing catalyst becomes deactivated, mainly by the deposition of coke (a highly carbonaceous hydrocarbon principally constituted by polycyclic aromatic compounds) and the accumulation of various catalyst poisons, principally heteroatom compounds, especially nitrogenous materials. This results in progressive loss of catalytic activity and selectivity for which compensation is made during the dewaxing cycle by progressively increasing the temperature. It is not, however, possible to continue the increase in temperature indefinitely because at higher dewaxing temperatures the stability of the products deteriorates. In practice, end-of-cycle (EOC) temperatures of about 650°–675° F. (about 343° to 357° C.) have become typical. After the dewaxing cycle has been completed, the dewaxing catalyst is given a restorative treatment to bring back its activity and selectivity. Oxidative regeneration is effective for this purpose and restores the catalyst by oxidative removal of coke and other catalyst inhibitors at relatively high temperatures.

Oxidative regeneration techniques are widely known and are described, for example, in U.S. Pat. Nos. 3,069,362, 3,069,363 and British Patent No. 1,148,545.

Another restorative technique is hydrogen reactivation, which is commonly employed between oxidative regenerations to remove accumulated coke or adsorbed material which can lower catalyst activity. Under the conditions employed in treatments of this kind, the hydrogen reacts with the coke to form hydrogen-enriched compounds which are more mobile and which are removed from the catalyst while adsorbed catalyst poisons are removed by the stripping action of the hydrogen. The hydrogen may be used as such or mixed with inert gases or gas mixtures such as nitrogen, methane, carbon dioxide, carbon monoxide or flue gas, as described, for example, in U.S. Pat. Nos. 4,358,395 and 4,508,836. The hydrogen reactivation treatment may be combined with other treatments, for example, with an alkylamine stripping step to remove nitrogenous poisons as described in U.S. Pat. No. 4,560,670.

The catalysts which have been treated by these hydrogen reactivation procedures used to remove accumulated coke are, naturally, those catalysts employed in processes in which coke is laid down. Thus, the hydrogen reactivation has been used on hydrocracking catalysts and dewaxing catalysts, as shown in U.S. Pat. Nos. 4,247,388 and 4,508,836. These treatments have not, however, been employed with catalysts used in hydrotreating or hydrofinishing processes in which coke deposition takes place slowly and, thus, frequent catalyst regeneration is not required. In processes of this kind, the catalyst comprises a porous substrate which is essentially non-acidic in character and which functions as a support for a metallic hydrogenation component, usually a metal of Groups VIA or VIIIA of the Periodic Table (IUPAC Table), for example, nickel, cobalt, molybdenum, tungsten, chromium, platinum or palladium. These metals are active catalysts for the hydrogenation reactions which are desired and which require no acidic functionality. Because little coke is produced during the hydrogenative processing, neither oxidative regeneration nor hydrogen reactivation has been considered to have any advantage for hydrotreating catalysts, especially since it might affect the distribution and functioning of the metal component on the catalyst. Accordingly, neither has been used with catalysts of this kind.

One problem which has been encountered in the hydrogen reactivation of the dewaxing catalyst is that the hydrogenated coke components which are removed from the catalyst by the hydrogen treatment are not completely purged from the dewaxing reactor: they remain sorbed on the catalyst and are released at the start of the next dewaxing cycle, with the initial dewaxing product. Because the dewaxing catalyst is at peak activity and selectivity at the start-of-cycle (SOC), the conventional practice is to process premium lube products, especially turbine oils, at this time in order to secure the enhanced product stability associated with the low operating SOC temperatures, typically about 500°–560° F. (about 260°–293° C.), it is these premium products which become contaminated with the reactivation products. The reactivation products are generally high boiling fractions due to their highly aromatic nature and they cannot, therefore, be readily separated from the lube products and because they are aromatic in character, they degrade the properties of the lubes significantly, especially in viscosity index (V.I.), viscosity and oxidation stability. These contaminated lube products therefore is generally discarded (slopped), which represents a considerable waste, especially of turbine oils and other high quality products which cannot be effectively produced during later portions of the dewaxing cycle. There is therefore a need for improving the lube dewaxing/hydrotreating process in order to reduce or eliminate start-up slopping and to improve the quality of the dewaxed lube products, especially at the start of the dewaxing cycle.

SUMMARY OF THE INVENTION

It has now been found that oxidative regeneration of the hydrotreating catalyst used in the catalytic lube dewaxing/hydrotreating process provides an amelioration of the process. The oxidatively regenerated hydrotreating catalyst has a high chromatographic activity which adsorbs aromatic compounds in the effluent from the dewaxing reactor very efficiently. It is therefore extremely effective for removing the highly aromatic residual reactivation products which come through in the dewaxer effluent during the early stages of each dewaxing cycle. This means that the SOC lube product does not have to be slopped and can be sent directly to the lube product tank or recycled to the charge tank for the solvent extraction unit or the dewaxer itself. In this way, waste of premium lube products, especially turbine oil, is reduced.

It has been found that oxygen regeneration of the hydrotreating (HDT) catalyst is capable of improving lube product V.I. by about 3 points at SOC and, furthermore, that the improvement persists at least to some degree throughout the cycle so that the EOC product has a V.I. which may be 1 or 2 points higher. In this respect, oxidative regeneration of the HDT catalyst is more advantageous than hydrogen reactivation because the improvement with the latter tends to be rather shorter-lived.

According to the present invention, therefore, there is provided a process for producing a low pour point lube of improved stability and other characteristics by catalytically dewaxing a hydrocarbon lubestock, preferably over an intermediate pore size dewaxing catalyst such as ZSM-5, and hydrotreating the catalytically dewaxed product over a hydrotreating catalyst which has been oxidatively regenerated. The lube products produced in this way are characterised by exceptional oxidative stability, V.I. and other properties.

DETAILED DESCRIPTION

The present reactivation process is employed with the hydrotreating catalyst of a two-step, catalytic dewaxing process in which a waxy, lube range hydrocarbon feed is first subjected to a shape-selective catalytic dewaxing, followed by hydrotreating to stabilize the product. The feed is first catalytically dewaxed, preferably by shape-selective cracking over an intermediate pore size zeolite such as ZSM-5, to bring the feed to the target pour point or to some other preselected fluidity specification such as freeze point and after this step, the dewaxed product is hydrotreated to improve lube product quality by saturating olefins and other unsaturates and removing trace quantities of compounds that lower oxidative and color stability.

Feedstock

The hydrocarbon feed is a lube range feed with an initial boiling point and final boiling point selected to produce a stock of suitable lubricating characteristics. Thus, the feed will typically have an initial boiling point of about 600° F. (about 315° C.) or higher, usually at least 650° F. (about 345° C.). The feed is conventionally reduced by the vacuum distillation of a fraction from a crude source of suitable type. Generally, the crude will be subjected to an atmospheric distillation and the atmospheric residuum (long resid) will be subjected to vacuum distillation to produce the initial lube stocks. The vacuum distillate stocks or "neutral" stocks used to produce relatively low viscosity paraffinic products typically range from 65–100 SUS (12–20 cSt) at 40° C. for a light neutral to about 750 SUS (160 cSt) at 40° C. or 12–45 cSt at 100° C. for a heavy neutral. The distillate fractions are usually subjected to solvent extraction to improve their V.I. and other qualities by selective removal of the aromatics using a solvent which is selective for aromatics such as furfural, phenol, or N-methylpyrrolidone. The vacuum resid may be used as a source of more viscous lubes after deasphalting, usually by propane deasphalting (PDA) followed by solvent extraction to remove undesirable, high viscosity, low V.I. aromatic components. The raffinate is generally referred to as Bright Stock and typically has a viscosity of 1000 to 3000 SUS at 100° C. (210 to 610 cSt).

The lube range feed may also be obtained by other procedures whose general objective is to produce an oil of suitable lubricating character from other sources, including marginal quality crudes, shale oil, tar sands and/or synthetic stocks from processes such as methanol or olefin conversion or Fischer-Tropsch synthesis. The lube hydrocracking process is especially adapted to use in a refinery for producing lubricants from asphaltic or other marginal crude sources because it employs conventional refinery equipment to convert the relatively aromatic (asphaltic) crude to a relatively paraffinic lube range product by hydrocracking. Integrated all-catalytic lubricant production processes employing hydrocracking and catalytic dewaxing are described in U.S. Pat. Nos. 4,414,097, 4,283,271, 4,283,272, 4,383,913, 4,347,121, 3,684,695 and 3,755,145. Processes for converting low molecular weight hydrocarbons and other starting materials to lubestocks are described, for example, in U.S. Pat. Nos. 4,547,612, 4,547,613, 4,547,609, 4,517,399 and 4,520,221, to which reference is made for a description of these processes.

Prior to catalytic dewaxing, the feed may be subjected to hydrotreating under conventional conditions, if necessary, to remove heteroatoms and possibly to effect some aromatics saturation.

As described above, the products which are processed at the beginning of each dewaxing cycle are the premium products such as turbine oil. These products are normally the neutral or distillate fractions from the vacuum distillation of a suitable crude source of paraffinic character. As such, these fractions are highly paraffinic in character with a low level of undesirable aromatics which has been further reduced by the solvent extraction step. They typically have an initial boiling point of at least 600° F. (about 315° C.), usually at least 650° F. (about 345° C.) and an end point of not more than about 1050° F. (about 565° C.) (ASTM D-1160). They also have a viscosity which typically ranges from about 65 to 1000 SUS at 40° C. (about 12 to 220 cSt). Typical specifications for turbine oil stocks are given below in Table 1.

TABLE 1

Typical Turbine Lube Stock Properties

| | Light Neutral | Heavy Neutral |
|---|---|---|
| Feed vis @ 40° C., cSt | 12.2–13.1 | |
| @ 100° C., cSt | | 10.4–11.3 |
| Product vis @ 40° C., cSt | 29.1–31.1 | |
| @ 100° C., cSt | | 12.5–13.5 |

TABLE 1-continued

| Typical Turbine Lube Stock Properties | | |
|---|---|---|
| | Light Neutral | Heavy Neutral |
| Minimum Product VI | 101 | 90 |
| Maximum Pour Point, °F.(°C.) | 20 (−7) | 20 (−7) |
| Maximum Flash Point, °F.(°C.) | 405 (207) | 450 (232) |
| Maximum Color | 0.5 | 2.0 |

Catalytic Dewaxing

The catalytic dewaxing step operates by selectively removing the longer chain, waxy paraffins, mainly n-paraffins and slightly branched paraffins from the feed. Most processes of this type operate by selectively cracking the waxy paraffins to produce lower molecular weight products which may then be removed by distillation from the higher boiling lube stock. The catalysts which have been proposed for this purpose have usually been zeolites which have a pore size which admits the straight chain, waxy n-paraffins either alone or with only slightly branched chain paraffins but which exclude the less waxy, more highly branched molecules and cycloaliphatics. Zeolites such as ZSM-5, ZSM-11, ZSM-12, ZSM-22,, ZSM-23, ZSM-35 and ZSM-38 have been proposed for this purpose in dewaxing processes, as described in U.S. Pat. Nos. Re 28,398 (3,700,585), 3,852,189, 3,894,938, 4,176,050, 4,181,598, 4,222,855, 4,229,282, 4,287,388, 4,259,170, 4,283,271, 4,283,272, 4,357,232 and 4,428,819 to which reference is made for details of such processes. A dewaxing process employing synthetic offretite is described in U.S. Pat. No. 4,259,174. A process using a mixture of zeolites of different pore sizes is disclosed in U.S. Pat. No. 4,601,993. Reference is made to these patents for details of such processes.

The catalytic dewaxing processes using intermediate pore size zeolites such as ZSM-5 operate, as described above, by selectively cracking the waxy components of the feed. This results in a loss in yield since the components which are in the desired boiling range undergo a bulk conversion to lower boiling fractions which, although they may be useful in other products, must be removed from the lube stock. Another approach to processing of lube stocks is described in U.S. Pat. Nos. 4,419,220 and 4,518,485, in which the waxy components of the feed, comprising straight chain and slightly branched chain paraffins, are removed by isomerization over a catalyst based on zeolite beta. During the isomerization, the waxy components are converted to relatively less waxy isoparaffins and at the same time, the slightly branched chain paraffins undergo isomerization to more highly branched aliphatics. A measure of paraffin cracking does take place during the operation so that not only is the pour point reduced by reason of the isomerization but, in addition, the heavy ends undergo some cracking or hydrocracking to form lower boiling range materials. The degree of cracking is, however, limited so as to maintain as much of the feedstock as possible in the desired boiling range.

In general, these catalytic dewaxing processes are operated under conditions of elevated temperature, usually ranging from about 400° to 800° F. (205° to 425° C.), but more commonly from 500° to 700° F. (260° to 370° C.), depending on the dewaxing severity necessary to achieve the target pour point. The temperature is increased during each dewaxing cycle to compensate for decreasing catalyst activity. Hydrogen is not required stoichiometrically but promotes extended catalyst life by reductive coke removal. The process is therefore carried out in the presence of hydrogen, typically at 400–800 psig (2860 to 562 kPa, abs.) although higher pressures can be employed. Hydrogen circulation rate is typically 1000 to 4000 SCF/bbl, usually 2000 to 3000 SCF/bbl of liquid feed (about 180 to 710, usually 355 to 535 n.l.l.$^{-1}$). Space velocity will vary according to the chargestock and the severity needed to achieve the target pour point but is typically in the range of 0.25 to 5 LHSV (hr$^{-1}$), usually 0.5 to 2 LHSV.

During the dewaxing cycle, the temperature of the dewaxing catalyst is progressively raised to compensate for the catalyst's decreasing dewaxing activity. Eventually, however, the temperature reaches a maximum end-of-cycle temperature, at which reactivation or regeneration of the dewaxing catalyst becomes necessary since excessively high temperatures increase the extent of non-selective catalytic and thermal cracking. Reactivation may be carried out using hydrogen at elevated temperatures as described, for instance, in U.S. Pat. Nos. 4,358,395 and 4,508,836, to which reference is made for details of such processes. Regeneration may be carried out oxidatively after several hydrogen reactivations to remove hard coke deposits.

Reactivation is typically carried out at temperatures of 600°–1000° F. (about 315°–540° C.) using at least 97 percent pure hydrogen at 200–600 psig (about 1480–4240 kPa abs) or higher, with a low water concentration in order to avoid hydrothermal deactivation of the zeolite component in the dewaxing catalyst. The reactivation typically takes 2–4 days.

Product Hydrotreating

In order to improve the quality of the dewaxed lube products, a hydrotreating step follows the catalytic dewaxing in order to saturate lube range olefins as well as to remove heteroatoms, color bodies and, if the hydrotreating pressure is high enough, to effect saturation of residual aromatics. Generally, however, the post-dewaxing hydrotreating is carried out in cascade with the dewaxing step so that the relatively low hydrogen pressure of the dewaxing step will prevail during the hydrotreating and this will generally preclude a significant degree of aromatics saturation. Generally, the hydrotreating will be carried out at temperatures from about 400° to 600° F. (about 205° to 315° C.), usually with higher temperatures for residual fractions (bright stock), (for example, about 425° to 575° F. (about 220° to 300° C.) for bright stock and, for example, about 425° to 500° F. (about 220° to 260° C.) for the neutral stocks. System pressures will correspond to overall pressures typically from 400 to 1000 psig (2860 to 7000 kPa, abs.) although lower and higher values may be employed. Space velocity in the hydrotreater is typically from 0.1 to 5 LHSV (hr$^{-1}$), and in most cases from 0.5 to 2 hr$^{-1}$.

Processes employing sequential lube catalytic dewaxing-hydrotreating are described in U.S. Pat. Nos. 4,181,598, 4,137,148 and 3,894,938. A process employing a reactor with alternating dewaxing-hydrotreating beds is disclosed in U.S. Pat. No. 4,597,854. Reference is made to these patents for details of such processes.

The post-dewaxing hydrotreating catalyst comprises a hydrogenation component on a porous support. Because the desired hydrogenation reactions require no acidic functionality and because no conversion to lower boiling products is desired in this step, the support is essentially non-acidic in character. Typical support materials include amorphous or crystalline oxide materials such as alumina, silica, and silica-alumina of non-acidic character. The metal hydrogenation component may be a noble metal such as palladium or platinum but base metals of Groups VIA or VIIIA (IUPAC Table) are also suitable, for example, nickel, cobalt, molybdenum and tungsten. Combinations of base metals such as cobalt-molybdenum, nickel-cobalt, nickel-molybdenum or nickel-tungsten are especially suitable. The metal content of the catalyst is typically up to about 20 weight percent for the base metals with lower proportions being appropriate for the more active noble metals. Hydrotreating catalysts of this type are readily available from catalyst suppliers. These catalysts are generally presulfided using $H_2S$ or other suitable sulfur containing compounds.

Although the post-dewaxing hydrotreating catalyst does not significantly lose its olefin saturation activity with time, it has now been found that the catalyst may be successfully oxidatively regenerated with the attendant advantages noted above. The regeneration treatment may be conveniently carried out simultaneously with or immediately after the hydrogen reactivation of the dewaxing catalyst. The oxidative regeneration typically takes only about 1–2 days with a reactor of typical size since the coke content of the catalyst is low. It is this fact which makes the effect of the treatment unexpected. Since relatively little coke is removed, little effect would be predicted but, as noted above, a significant improvement in product quality is obtained which persists to some degree throughout the dewaxing/hydrotreating cycle.

The oxidative regeneration of the hydrotreating catalyst is carried out in a manner similar to that which may be employed with the dewaxing catalyst after successive hydrogen reactivations. Air or oxygen-reduced air is passed over the catalyst at an elevated temperature, typically about 600° to 1000° F. (about 315° to 540° C.) preferably, 650° to 950° F. (about 315 to 510° C.). The use of oxygen-reduced air is desirable in order to prevent exotherms which might damage the catalyst.

The regeneration is preferably carried out with an initial low concentration of oxygen in the regeneration gas when the coke level on the catalyst is relatively high, in order to reduce the exotherm. Oxygen concentrations of 0.1–0.5 volume percent are suitable and may be obtained by mixing air with an inert gas such as nitrogen or flue gas. System pressures of 100–300 psig (about 800–2170 kPa abs) are typical throughout the regeneration, although higher pressures may also be employed. Water partial pressures need not be closely controlled since the hydrotreating catalyst is not excessively sensitive to water at normal regeneration temperatures. As coke is removed from the catalyst, the oxygen concentration in the regeneration gas may be increased, suitably to 0.5 to 2.0 volume percent. Inlet temperatures of 650°–725° F. (about 345°–385° C.), preferably about 700° F. (about 370° C.) are typical at this point. After the exotherm diminishes, reactor inlet temperature may be increased to complete the regeneration, typically to temperatures of about 850°–900° F. (about 455°–510° C.) and at this time the oxygen concentration of the regeneration gas may also be increased, suitably to 10–15 volume percent, after which the regeneration may be held at this temperature and oxygen concentration for several hours e.g. 4–8 hours, until regeneration is complete, after which a presulfiding step may be carried out in a conventional manner, typically for 1–2 days.

After hydrogen reactivation of the dewaxing catalyst and oxidative regeneration of the hydrotreating catalyst, premium products such as turbine oils may be processed with reduced loss because of contamination with reactivation products from the dewaxing reactor. The regenerated hydrotreating catalyst effectively and efficiently sorbs the aromatic components in the effluent from the dewaxing reactor to produce a lube product of improved V.I., lower viscosity and improved oxidation stability. The sorbed aromatic components, including the partly hydrogenated, highly polycyclic liquids formed by the hydrogenative reactivation of the dewaxing catalyst, remain on the hydrotreating catalyst until the next oxidative regeneration, when they will be removed together with the coke and other poisons and inhibitors.

I claim:

1. A method of producing a catalytically dewaxed, hydrotreated lubricating oil of improved quality, which comprises:

(i) catalytically dewaxing a hydrocarbon lubricating oil fraction by contacting the fraction during a dewaxing/hydrotreating cycle with a zeolitic dewaxing catalyst in the presence of hydrogen under dewaxing conditions, to produce a dewaxed effluent, (ii) hydrotreating the dewaxed effluent by contacting the effluent during the dewaxing/hydrotreating cycle with a hydrotreating catalyst comprising a metal hydrogen component on a porous non-acidic support in the presence of hydrogen under hydrotreating conditions, to produce a hydrotreated, dewaxed effluent, (iii) reactivating the dewaxing catalyst at the end of the dewaxing/hydrotreating cycle by contacting the dewaxing catalyst with hydrogen at an elevated temperature to restore dewaxing activity to the catalyst, (iv) oxidatively regenerating the hydrotreating catalyst at the end of the dewaxing/hydrotreating cycle by contacting the hydrotreating catalyst with an oxygen-containing gas at an elevated temperature to restore hydrotreating activity to the catalyst, (v) repeating steps (i) and (ii) with the reactivated dewaxing and regenerated hydrotreating catalysts in a new dewaxing/hydrotreating cycle in which aromatic components formed by the hydrogenative reactivation of the dewaxing catalyst in step (iii) and sorbed on the dewaxing catalyst pass with the dewaxed effluent form the dewaxing catalyst to the hydrotreating catalyst on which they are sorbed during the initial stages of the dewaxing-/hydrotreating cycle.

2. A method according to claim 1 in which the lubricating oil fraction which is dewaxed and hydrotreated in the dewaxing and hydrotreating cycle immediately after the reactivation and regeneration of the catalysts is a turbine oil.

3. A method according to claim 1 in which the lubricating oil fraction is dewaxed by contact with an intermediate pore size zeolite dewaxing catalyst.

4. A method according to claim 3 in which the intermediate pore size zeolite is ZSM-5.

5. A method according to claim 1 in which the hydrotreating catalyst comprises a base metal hydrogenation component comprising at least one of nickel, cobalt, molybdenum and tungsten on a support of alumina, silica or silica-alumina.

6. A method according to claim 1 in which the hydrotreating catalyst is contacted with the oxygen-containing gas at a temperature from 650° to 1000° F.

7. A method according to claim 1 in which the hydrotreating catalyst is contacted with the oxygen-containing gas at a temperature from 700° to 950° F.

* * * * *